United States Patent [19]

Ahs

[11] Patent Number: 4,680,108

[45] Date of Patent: Jul. 14, 1987

[54] SCREENING DEVICE

[75] Inventor: Bjorn Ahs, Karlstad, Sweden

[73] Assignee: Kamyr AB, Karlstad, Sweden

[21] Appl. No.: 836,123

[22] Filed: Mar. 4, 1986 (Under 37 CFR 1.47)

[30] Foreign Application Priority Data

Mar. 4, 1985 [SE] Sweden ..... 8501030

[51] Int. Cl.[4] ..... B07B 1/04

[52] U.S. Cl. ..... 209/273; 209/358; 209/379; 209/389

[58] Field of Search ..... 210/413, 414, 415; 209/268, 277, 262, 379, 358, 380, 389, 273; 241/46.17, 46.06, 46.11, 69, 70, 73

[56] References Cited

U.S. PATENT DOCUMENTS

| | | | |
|---|---|---|---|
| 625,131 | 5/1899 | Abbott | 210/415 |
| 3,034,650 | 5/1962 | Szepan | 210/415 |
| 4,543,181 | 9/1985 | Greenwood . | |

FOREIGN PATENT DOCUMENTS 955563 10/1974 Canada .

*Primary Examiner*—Frank Sever

*Attorney, Agent, or Firm*—Nixon & Vanderhye

[57] ABSTRACT

A device for screening fluidizible suspensions, such as medium consistency (e.g. 6–15 percent solids) paper pulp includes a housing with a main suspension inlet and a main (rejects) outlet. A rotor having a plurality of ribs is mounted in the housing for rotation about an axis. A stationary screen, which may be a planar screen or a cylinder, is disposed in the housing between the main inlet and outlet. The stationary screen defines, with the housing, a chamber, and the rotor is positioned so that the ribs sweep past the screen, with only a small clearance between the screen and ribs. One or more dividing walls divide the chamber into a plurality of accept chambers, the dividing wall(s) extending radially when the screen is cylindrical, and parallel to the axis of rotation when the screen is planar. Dilution liquid may be added at the wall area between accept chambers. A rotor in the shape of a drum is used with the cylindrical screen, and a disc shaped rotor with the planar screen. The rotor also includes vanes at a portion adjacent the rejects outlet to facilitate pumping of rejects out the outlet, and dilution liquid may be added to further facilitate pumping of rejects out the outlet.

20 Claims, 7 Drawing Figures

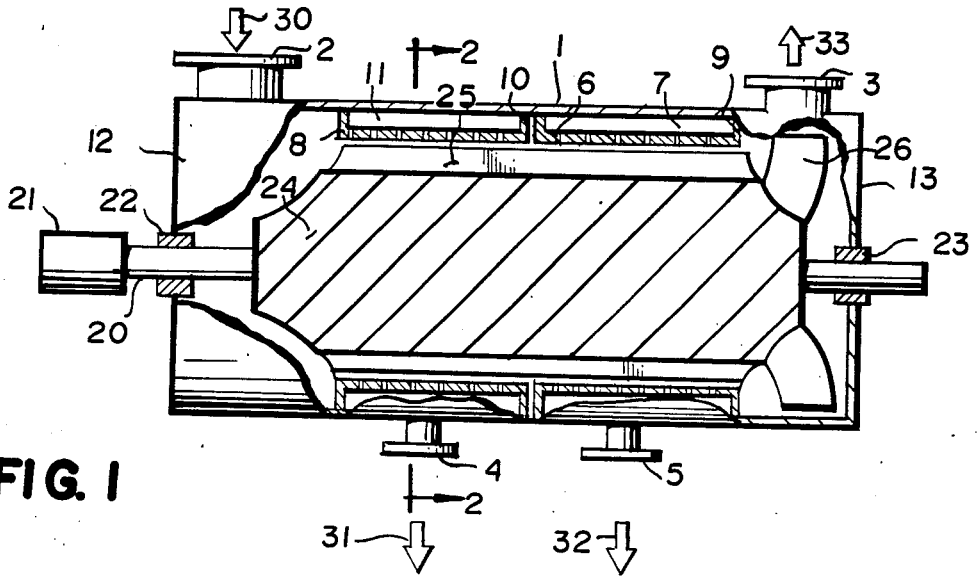
FIG. 1
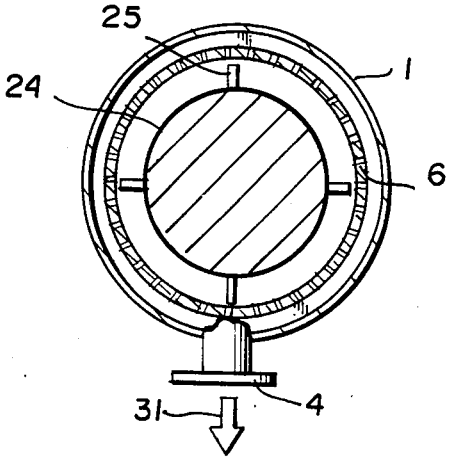
FIG. 2
FIG. 6
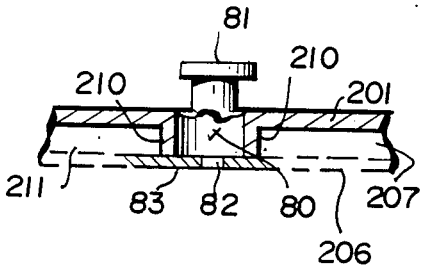
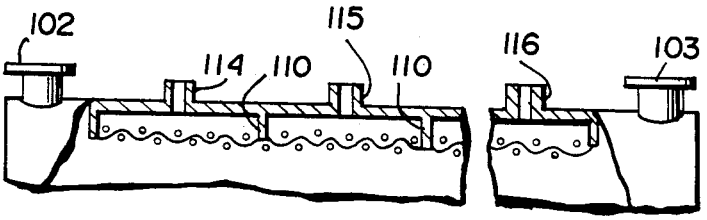
FIG. 5

FIG. 3
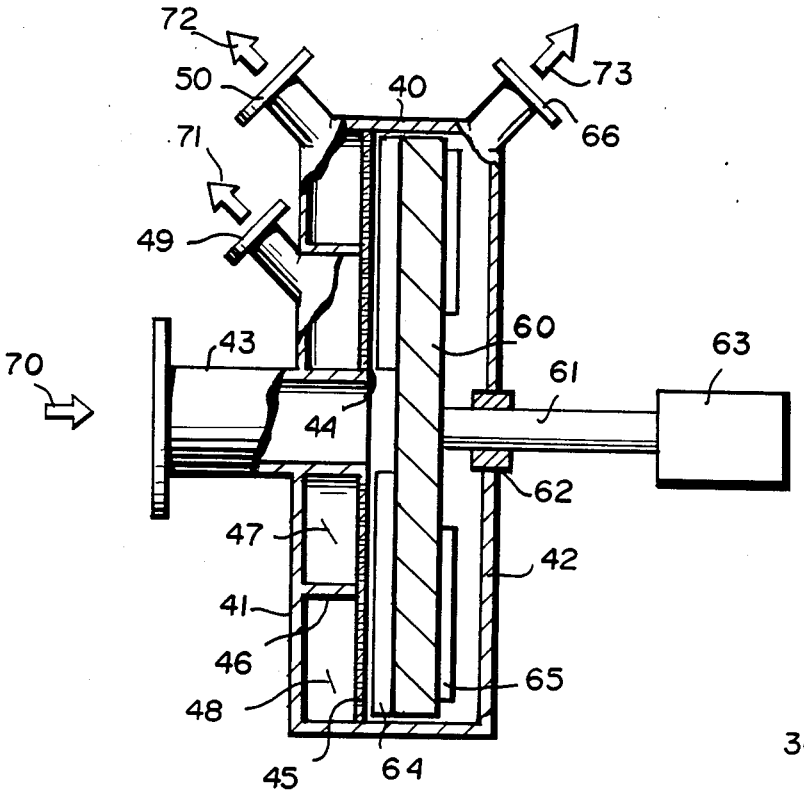
FIG. 7
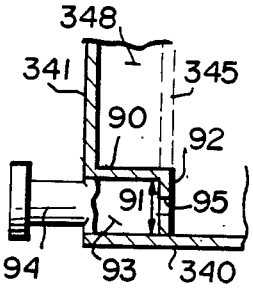
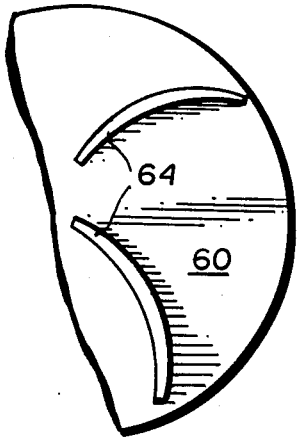
FIG. 4

SCREENING DEVICE

BACKGROUND AND SUMMARY OF THE INVENTION

In the screening of fluidizible suspensions, such as medium consistency paper pulp, it is desirable to utilize a simple yet effective apparatus, and one which will allow the production of a number of different accept streams. Medium consistency pulp typically is pulp having a consistency of about 6–15 percent, and most typically within the range of about 8–12 percent solids. In order to effectively screen such suspensions, it is necessary to fluidize them by producing pulsations and shear forces in the suspension. When the suspension is fluidized the fibers or other solid materials therein move relatively to each other, and can be separated according to different sizes, shapes, or weights utilizing the appropriate screening apparatus.

According to the present invention a simple yet effective screening device is provided which is particularly adapted for screening medium consistency pulp, although it may also be utilized in the screening of other fluidizible suspension. Typical pulps with which the invention can be utilized are chemical pulps, or mechanical pulps such as TMP, CTMP, or the like. Utilizing the invention, it may be possible to effect primary and secondary screening within the same device, thereby saving energy and equipment (and resulting capital investment). Two, three, or more accept streams may be generated from a single screening apparatus.

It is the primary object of the present invention to provide a simple and effective screening apparatus for producing a plurality of different accept streams, and one that is utilizable with a wide variety of suspensions including medium consistency pulp. This and other objects of the invention will become clear from an inspection of the detailed description of the invention, and from the appended claims.

BRIEF DESCRIPTION OF THE DRAWINGS

FIG. 1 is a side view, partly in cross-section and partly in elevation, of a first embodiment of exemplary apparatus according to the present invention;

FIG. 2 is a longitudinal cross-sectional view taken along lines 2–2 of FIG. 1;

FIG. 3 is a side view, partly in cross-section and partly in elevation, of a second embodiment of exemplary apparatus according to the present invention;

FIG. 4 is a top plan view of a portion of the disc-shaped rotor of FIG. 3, illustrating an exemplary form the ribs thereon may take;

FIG. 5 is a partial side view, partly in cross-section and partly in elevation and with the rotor removed, showing a large number of different accept chambers for generating different accept streams; and FIGS. 6 and 7 are detail cross-sectional views of dilution liquid adding structures that may be employed, particularly in the FIGS. 1 and 3 embodiments respectively.

DETAILED DESCRIPTION OF THE DRAWINGS

In the embodiment illustrated in FIG. 1, an exemplary device according to the invention includes a housing 1 which is circular in cross-section, and includes a main inlet 2 at one end thereof, and a main (rejects) outlet 3 at the opposite end thereof from the inlet 2. End walls 12 and 13 are provided, and a rotor 24 is disposed in the housing and extends generally along the length thereof. The rotor is rotatable about an axis defined by the shaft 20, the shaft being mounted in bearings 22 and 23 at the end walls 12 and 13, for rotation with respect to the housing 1. A suitable powered driving device 21 comprises means for effecting rotation of the rotor 24 about its axis.

Disposed on the periphery of the rotor 24 are a plurality of ribs 25. The ribs may extend completely axially along the length of the rotor 24, or as illustrated by rib 25' in FIG. 2, may have an arcuate configuration (that is extend in a genreally screw-thread manner along the rotor 24). The powered means 21 rotates the rotor 24 and ribs or blades 25 in such a way that the suspension flowing in the housing 1 is fluidized. For example, for a pulp having a consistency of between about 6–15 percent, if the rotor 24 is rotated at 1500 revolutions per minute (by a motor 21 which is a 250 kW motor), the ribs or blades 25 will have a speed of about 20–25 m/second which will be sufficient to fluidize and screen approximately 6 tons of pulp per hour.

The device according to the invention also includes a stationary screen means operatively disposed in the housing 1 between the inlet 2 and outlet 3, the screen means defining, with the housing 1, a chamber. In the embodiment illustrated in FIGS. 1 and 2, the screen means comprises a cylindrical screen body 6 which defines a volume between it and the housing 1. The ends of the screen 6 are connected to the housing by end rings 8 and 9. Note that the rotor 24 is mounted within the housing 1 with respect to the cylindrical screen 6 so that the blades 25 sweep past the interior cylindrical surface of the screen 6 during rotation, a small clearance being provided between the blades 25 and the screen 6.

The device according to the invention also comprises means for dividing the chamber between the screen 6 and housing 1 into a plurality of accept chambers—chambers 7 and 11 in FIG. 1. The dividing means preferably takes the form of the wall 10, which is a ring shaped wall which extends generally perpendicular to the axis of rotation defined by the shaft 20, and generally parallel to the direction in which suspension 30 is introduced into the inlet 2. Each accept chamber 11, 7 has associated therewith its own accept outlet (outlets 4, 5, respectivley), so that two different accept streams 31, 32 are produced.

The rotor 24 also preferably has associated therewith a plurality of vanes 26 at the portion thereof adjacent the main outlet 33. The vanes 26 act like vanes of a pump, and facilitate movement of the rejects out of the housing 1 in a rejects stream 33. Dilution liquid (e.g. water) may be added to the reject stream via inlet 37 to facilitate the flow of rejects out of outlet 3.

Utilizing the apparatus of FIGS. 1 and 2, it will thus be seen that the introduced suspension 30 flows primarily axially through the housing 1, is divided into two accept streams 31, 32, and then the rejects are pumped out through outlet 3 in the rejects stream 33.

While the embodiment of FIGS. 1 and 2 has been illustrated with only two accept chambers 11, 7 it is to be understood that three, or even more, accept chambers may be provided. FIG. 5 illustrates an embodiment in which a plurality of radially extending dividing walls 110 are provided, defining a plurality of accept chambers each having its own accept stream outlet 114, 115, 116 associated therewith, the outlets 114–116 being disposed between the main inlet 102 and rejects outlet 103.

FIGS. 3 and 4 illustrate another embodiment of a screening device according to the present invention. In the embodiment of FIGS. 3 and 4, the housing 40 has a main inlet 43 and rejects outlet 66 associated therewith, the inlet 43 disposed in the center of the circular end wall 41 of the housing 40. The ciruclar end wall 42 of the housing 40 is disposed opposite the wall 41, and has a bearing 62 disposed centrally thereof through which the shaft 61 extends, the shaft interconnecting the disc-shaped rotor 60 and the motor 63 which effects rotation of the shaft 61 and rotor 60 about an axis of rotation to effect fluidization of the suspension 70 introduced into the inlet 43.

An interior end 44 of the inlet 43 is connected to the screen means 45, which is in the form of a screen plate. The screen plate is annular, being open at the center through which the suspension 70 flows. The volume between the screen plate 45 and the end wall 41 of housing 40 is divided into a plurality of accept chambers, by one or more annular walls 46, the walls elongated in a dimension parallel to the axis of rotation of the shaft 61, and to the direction of flow of suspension 70 into the housing 40. In the embodiment actually illustrated in the drawing, two different accept chambers 47, 48 are defined by the annular wall 46, each having an accept outlet 49, 50 associated therewith so that two different accept streams 71, 72 are provided.

On the flat surface of the disc-shaped rotor 60 adjacent the planar screen 45, a plurality of blades or ribs 64 are provided. These ribs 64 sweep past the screen 45 during rotation of rotor 60, and a small clearance is provided between the screen plate 45 and the ribs 64. On the opposite side of the rotor 60 from the ribs 64 a plurality of vanes 65 are provided. The vanes effect pumping of rejects out of the housing 40, through outlet 66, in rejects stream 73. Note that the ribs 64 (and vanes 65) may either extend radially along the disc 60, or may be arcuate, as illustrated for the ribs 64 in FIG. 4. Dilution liquid is preferably added to the rejects stream through dilution liquid inlet 75.

In the utilization of the embodiment of FIGURES 3 and 4, the suspension 70 introduced into inlet 43 flows radially outwardly in the housing 40 past the accept chambers 47, 48. The accepts flow through the screen 45 into those chambers 47, 48, and the reject material passes between the peripheral exterior of the disc 60 and the housing 40, and then is pumped by vanes 65 to the outlet 66.

The device according to the present invention may be constructed for operation at atmospheric pressure, but is preferably constructed for operation at superatmospheric pressure. The performations in the screen means may be of any suitable configuration for the type of screening desired. For instance they can comprise holes, slits, or any of a wide variety of other types of perforations. Also, the size and/or shape, of the perforations, holes, or slits of the screen means can be made different at different areas of the screen means so that the type of material that will flow into each of the accept chambers is different. For example, the portion of the screen plate 45 associated with the accept chamber 47 can have larger holes formed therein than the portion of the screen plate 45 associated with the accept chamber 48.

In some situations, when the pulp passes the accept chambers it is thickened to such a degree that in order to properly perform screening in succeeding accept chambers it is necessary to dilute the pulp suspension so that it has approximately the same consistency as prior to passing the previous accept chamber(s). FIGS. 6 and 7 illustrate exemplary embodiments for effecting introduction of dilution liquid.

In FIG. 6, elements functionally corresponding to those in the FIG. 1 embodiment are shown by the same two digit reference numeral only preceded by a "2". Two annular dividing walls 210 are provided for separating the chambers 211, 207, the walls 210 being spaced from each other a distance so as to provide a header 80 for the introduction of dilution liquid (e.g. water) through the dilution liquid inlet 81. A plurality of openings 82 are provided in an inner wall 83 spaced around the circumference thereof, sufficient dilution liquid being added through the openings 82 so that the suspension at the start of the portion of the screen 206 by chamber 207 has substantially the same consistency as the pulp when it started passage past the chamber 211. Note also in this embodiment further dilution liquid can be provided by providing a wall comparable to the wall 9 of the FIG. 1 embodiment which again is a spaced pair of walls defining a dilution liquid header so that dilution liquid is added to the pulp after it has passed past the chamber 207. In the FIG. 5 embodiment, all of the dividing walls 110 may be made double walls, such as the walls 210 of FIG. 6, for adding dilution liquid.

In the FIG. 3 embodiment the annular wall 46 could also be made a double wall, like the walls 210 in the FIG. 6 embodiment. Also, in the FIG. 3 embodiment, dilution liquid addition can be provided after the chamber 48 by utilizing the dilution liquid adding means illustrated in FIG. 7. In the FIG. 7 embodiment structures comparable to those in the FIG. 3 embodiment are shown by the same two digit reference numeral only preceded by a "3". The end wall of the housing 340 at the portion where it abuts the wall 341 has an interior solid wall 90 formed therein, the wall 90 being an annular wall extending around the interior of the housing 340 spaced the same distance 91 from the end wall along its entire extent. The interior annular wall 90 and the end wall, as well as the wall 92, forms a header 93 into which dilution liquid is introduced by the dilution liquid inlet 94. A plurality of holes 95 are formed in the wall 92 at predetermined spaced positions along the extent thereof so that dilution liquid can flow through the inlet 94 into the header 93 and through openings 95 to appropriately dilute the liquid that has passed past the accept chamber 348.

It will thus be seen that according to the present invention a simple yet effective screening device has been provided, which is utilizable for screening a wide variety of suspensions including medium consistency pulp. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A device for screening a fluidizible suspension comprising:

a housing including a main inlet and a main outlet;

a rotor having a plurality of ribs formed thereon;

stationary screen means operatively disposed in said housing between said main inlet and outlet; said stationary screen means defining, with said housing, a chamber;

means for mounting said rotor in said housing for rotation about an axis, with said ribs rotating past said stationary screen means with a small clearance between said stationary screen means and said ribs;

means for effecting primary and secondary screening within the same device, comprising means on the outlet side of said screen for dividing said chamber into a plurality of accept chambers; and an accept outlet operatively associated with each accept chamber and extending outwardly from said housing.

2. A device as recited in claim 1 wherein said means for dividing said chamber comprises at least one wall extending parallel to said inlet.

3. A device as recited in claim 1 wherein said means dividing said chamber comprise at least one wall extending parallel to the axis of rotation of said rotor.

4. A device as recited in claim 1 wherein said means for dividing said chamber comprises at least one wall extending perpendicular to said axis of rotation.

5. A device as recited in claim 1 further comprising a plurality of vanes disposed on said rotor adjacent said main outlet for effecting movement of rejects from the interior of said housing toward said main outlet; and further comprising dilution liquid adding means for adding dilution liquid to the suspension which passes the accept chambers to facilitate discharge of rejects from the housing.

6. A device as recited in claim 1 wherein said screen means comprises a planar screen.

7. A device as recited in claim 6 wherein said main inlet is provided at a central portion of said housing, and whreein said accept chambers are annular in shape, extending radially outwardly from said main inlet.

8. A device as recited in claim 7 wherein said main outlet is at a circumferential peripheral portion of said housing and on the opposite side of said rotor from said main inlet.

9. A device as recited in claim 1 wherein said screen means comprises a cylindrical screen element.

10. A device as recited in claim 9 wherein said accept chambers are annular in shape, and axially spaced from each other along said housing and axis of rotation of said rotor.

11. A device as recited in claim 1 wherein said rotor is drum shaped.

12. A device as recited in claim 11 further comprising means for effecting rotation of said rotor at a speed sufficient to effect fluidization of said fluidizible suspension.

13. A device as recited in claim 12 wherein said housing and main inlet are dimensioned and positioned with respect to said rotor and said main outlet so that fluidizible suspension primarily is introduced, and flows along, said axis of rotation; and further comprising a plurality of vanes disposed on said rotor adjacent said main outlet for effecting movement of rejects from the interior of said housing toward said main outlet.

14. A device as recited in claim 11 wherein said ribs are arcuately shaped.

15. A device as recited in claim 1 wherein said dividing means comprise spaced walls defining a header, and wherein said header is part of means for introducing dilution liquid in said housing between accept chambers.

16. Apparatus as recited in claim 1 wherein said rotor is disc shaped.

17. A device as recited in claim 16 further comprising means for effecting rotation of said rotor at a speed sufficient to effect fluidization of said fluidizible suspension.

18. A device as recited in claim 17 further comprising a plurality of vanes disposed on said rotor adjacent said main outlet for effecting movement of rejects from the interior of said housing toward said main outlet.

19. A device as recited in claim 16 wherein said ribs are arcuately shaped.

20. A device as recited in claim 1 wherein the portion of said screen means associated with an accept chamber is different than the portion of the screen means associated with another of the accept chambers, in the size, shape, and/or configuration of perforations, slits, or holes formed in the screen means.

* * * * *